US007699176B2

(12) United States Patent
Lin

(10) Patent No.: US 7,699,176 B2
(45) Date of Patent: Apr. 20, 2010

(54) TOOL BOX WITH PIVOTABLE STORAGE RACKS

(76) Inventor: Fu-Hui Lin, No. 113, Lane 60, Gong-Jiew Street, Ta-Li City, Taichung County (TW)

( * ) Notice: Subject to any disclaimer, the term of this patent is extended or adjusted under 35 U.S.C. 154(b) by 280 days.

(21) Appl. No.: 11/821,297

(22) Filed: Jun. 22, 2007

(65) Prior Publication Data

US 2008/0314795 A1 Dec. 25, 2008

(51) Int. Cl.
*B65D 5/50* (2006.01)

(52) U.S. Cl. ..... 206/759; 206/372; 206/234; 206/379

(58) Field of Classification Search ..... 206/234, 206/759, 372–379; 312/271, 272, 270.2, 312/902

See application file for complete search history.

(56) References Cited

U.S. PATENT DOCUMENTS 4,799,604 A * 1/1989 Okojima et al. ..... 220/260
6,105,770 A * 8/2000 Vasudeva ..... 206/378
6,415,923 B1 * 7/2002 Chen ..... 206/379
6,915,900 B2 * 7/2005 Chen ..... 206/350
6,988,616 B2 * 1/2006 Chen ..... 206/379
7,021,464 B2 * 4/2006 Chen ..... 206/379
7,032,750 B2 * 4/2006 Amtenbrink ..... 206/379
7,168,559 B2 * 1/2007 Chen ..... 206/373
7,428,970 B2 * 9/2008 Chen ..... 206/372
2003/0226779 A1 * 12/2003 Chen ..... 206/373
2006/0226042 A1 * 10/2006 Seymour et al. ..... 206/379

* cited by examiner

*Primary Examiner*—Jacob K Ackun, Jr.
*Assistant Examiner*—Robert Poon

(57) ABSTRACT

A tool box includes a cover pivotably connected to a base, at least one torsion spring is located between the cover and the base to maintain the cover at opened status when in use. A magnetic member is connected to an inside of the cover so that the user can position the spare bits by the magnetic member. A plurality of storage racks are pivotably connected to the base so as to receive bits and tools, the storage racks are cooperated with torsion springs so that when the cover is opened, the storage racks are pivoted an angle.

5 Claims, 4 Drawing Sheets

TOOL BOX WITH PIVOTABLE STORAGE RACKS

FIELD OF THE INVENTION

The present invention relates to a tool box with a plurality of storage racks which are pivoted an angle when the cover is opened.

BACKGROUND OF THE INVENTION

A conventional tool box generally includes a base and a cover which is pivotably connected to the base, and each of the base and the cover includes recesses defined therein so as to receive bits or tools. The bits or tools received in the recesses are located on the inside of the base or cover so that the user has to carefully grab the small bits or tools to remove them from the recesses. After the desired bits are picked up, the cover should be closed to prevent the bits or tools from dropping from the tool box. Therefore, the user has to open and close the cover every time when he or she needs another bits or wants to put the bits into the tool box. Even if the user holds multiple bits at hand and replaces them without opening and closing the cover of the tool box, the user can only use one hand to operate the tool such as pneumatic tools and this can be dangerous.

The present invention intends to provide a tool box which includes torsion springs to maintain the cover at open status and a magnetic member is connected to the inside of the cover so that the spare bits can be positioned in the cover which is maintained at horizontal position.

SUMMARY OF THE INVENTION

The present invention relates to a tool box which comprises a cover pivotably connected to a side of a base. A first locking member is connected to an inside of a front wall of the cover so as to be connected with a second locking member on a front wall of the base. At least one torsion spring is located between the cover and the base to maintain the cover at opened status when the first locking member is separated from the second locking member. A magnetic member is connected to an inside of the cover so as to position spare bits and tools.

The primary object of the present invention is to provide a tool box wherein the cover is maintained at substantially horizontal position when being opened and a magnetic member is connected to the cover to position spare bits and tools.

Another object of the present invention is to provide a tool box that includes a plurality of pivotable storage racks which are pivoted an angle when the cover is opened.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
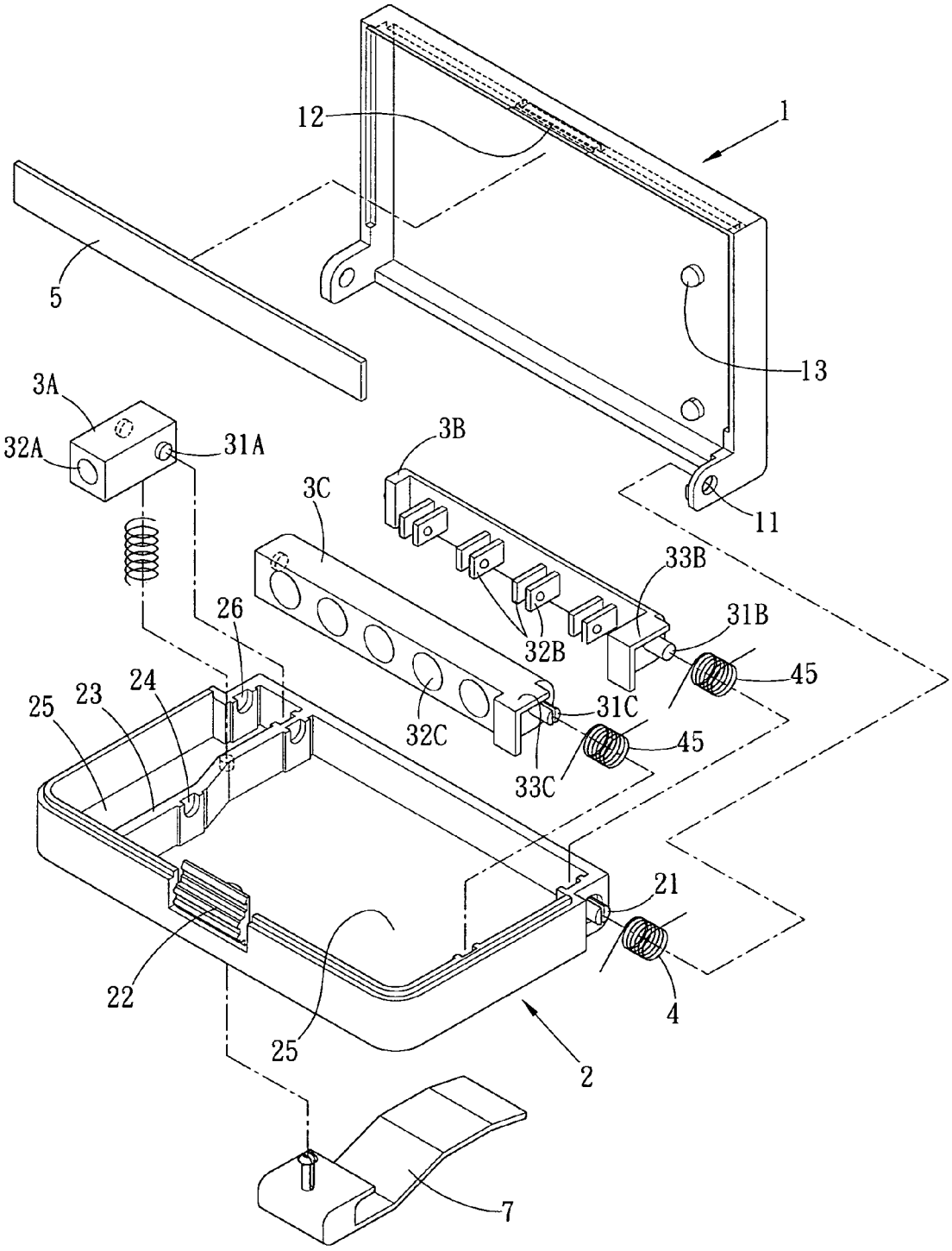
FIG. 1 is an exploded view to show the tool box of the present invention.
Figure 2:
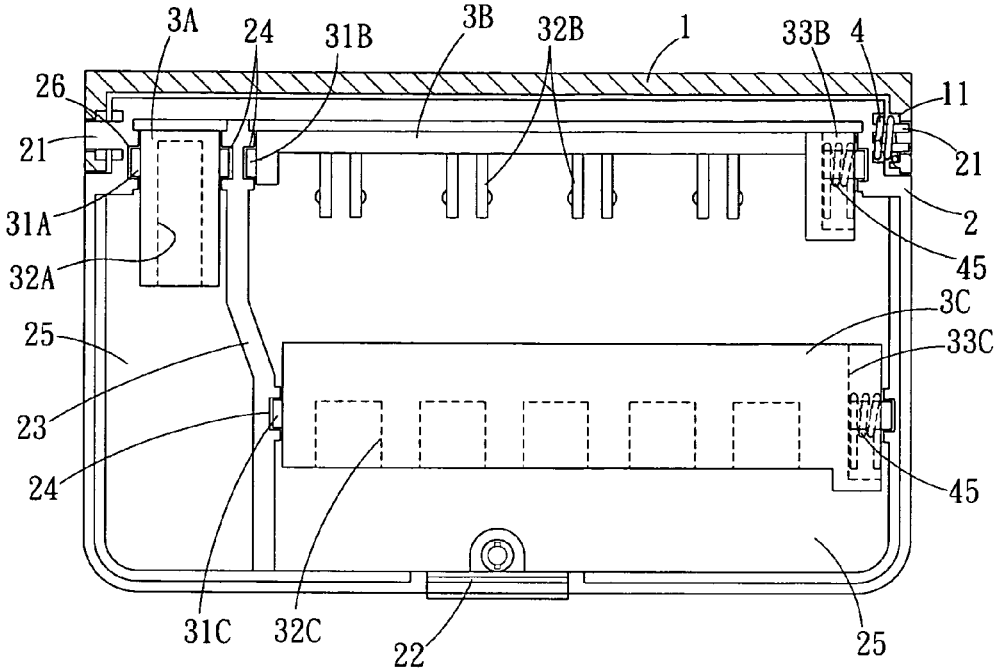
FIG. 2 shows a top cross sectional view of the tool box of the present invention.
Figure 3:
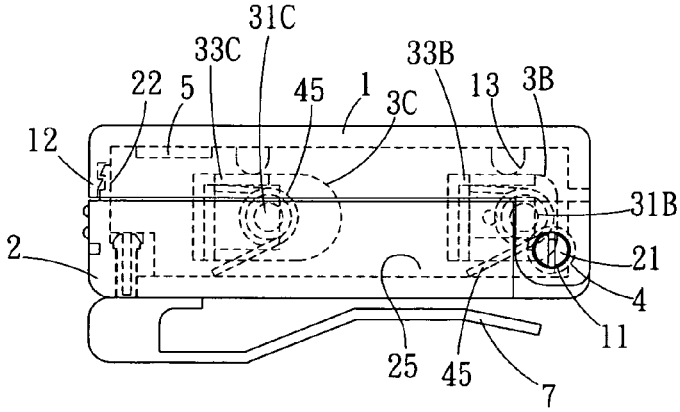
FIG. 3 is an end view to show when the cover is closed.
Figure 4:
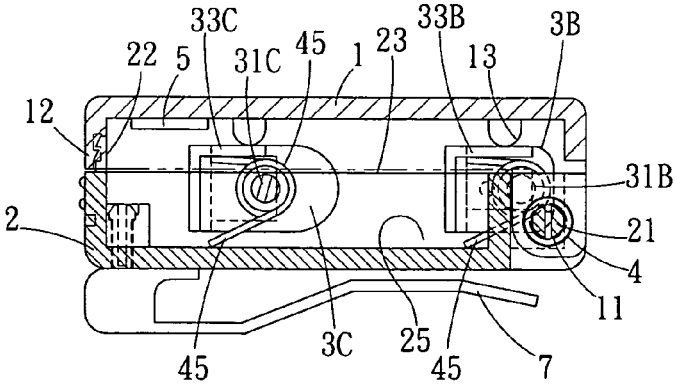
FIG. 4 is an end cross sectional view to show the torsion springs on the protrusions of the storage racks.
Figure 5:
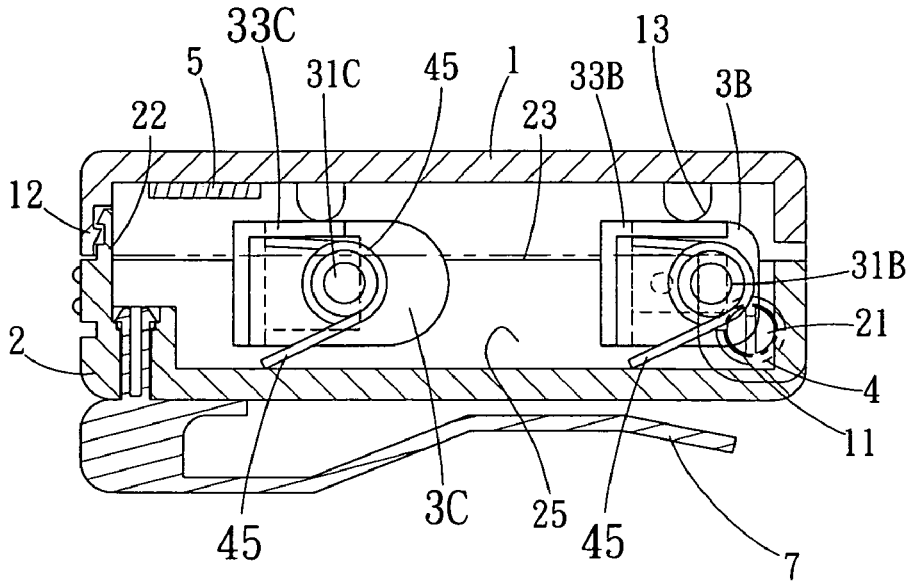
FIG. 5 shows another end cross sectional view of the tool box of the present invention.
Figure 6:
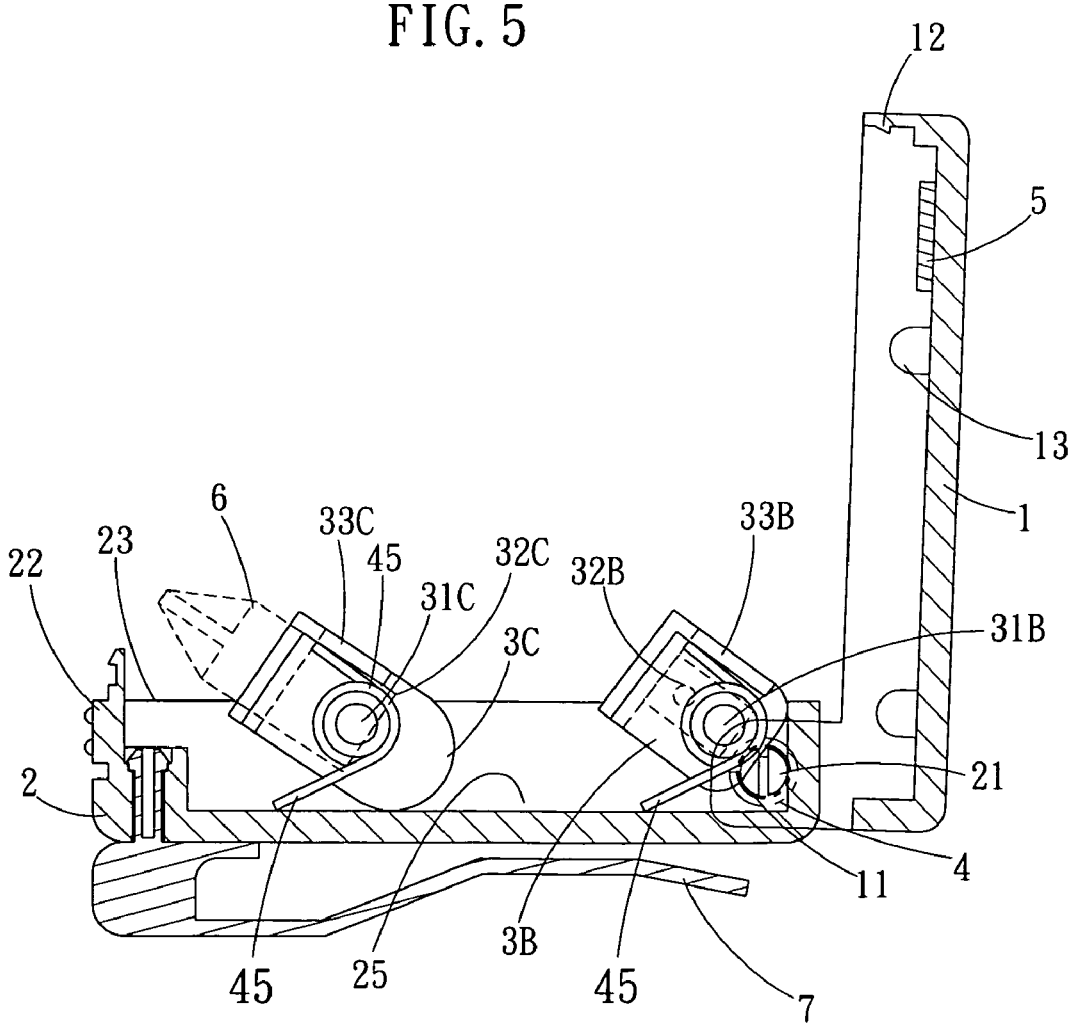
FIG. 6 is a cross sectional view to show that when the cover is opened.

Referring to FIGS. 1 to 5, the tool box of the present invention comprises a cover 1 which includes two lugs on two ends of a side thereof and each lug includes a hole 11. A first locking member 12 is connected to an inside of a front wall of the cover 1 and a magnetic member 5 is connected to an inside of the cover 1. The magnetic member 5 can be glued or snapped to the cover 1 by any known methods. A plurality of pressing members 13 are connected to the inside of the cover 1.

A base 2 includes two pivots 21 on two ends of the side, and the pivots 21 extend through the two holes in the lugs of the cover 1. A second locking member 22 is connected to a front wall of the base 2 and the first locking member 12 on the cover 1 is disengagably snapped with the second locking member 22 on the base 2 to close the tool box. At least one torsion spring 4 is mounted to one of the pivots 21 and includes two legs which are in contact with the cover 1 and the base 2. By the torsion spring 4, the cover 1 can be maintained at opened status when the first locking member 12 is separated from the second locking member 22.

Figure 7:
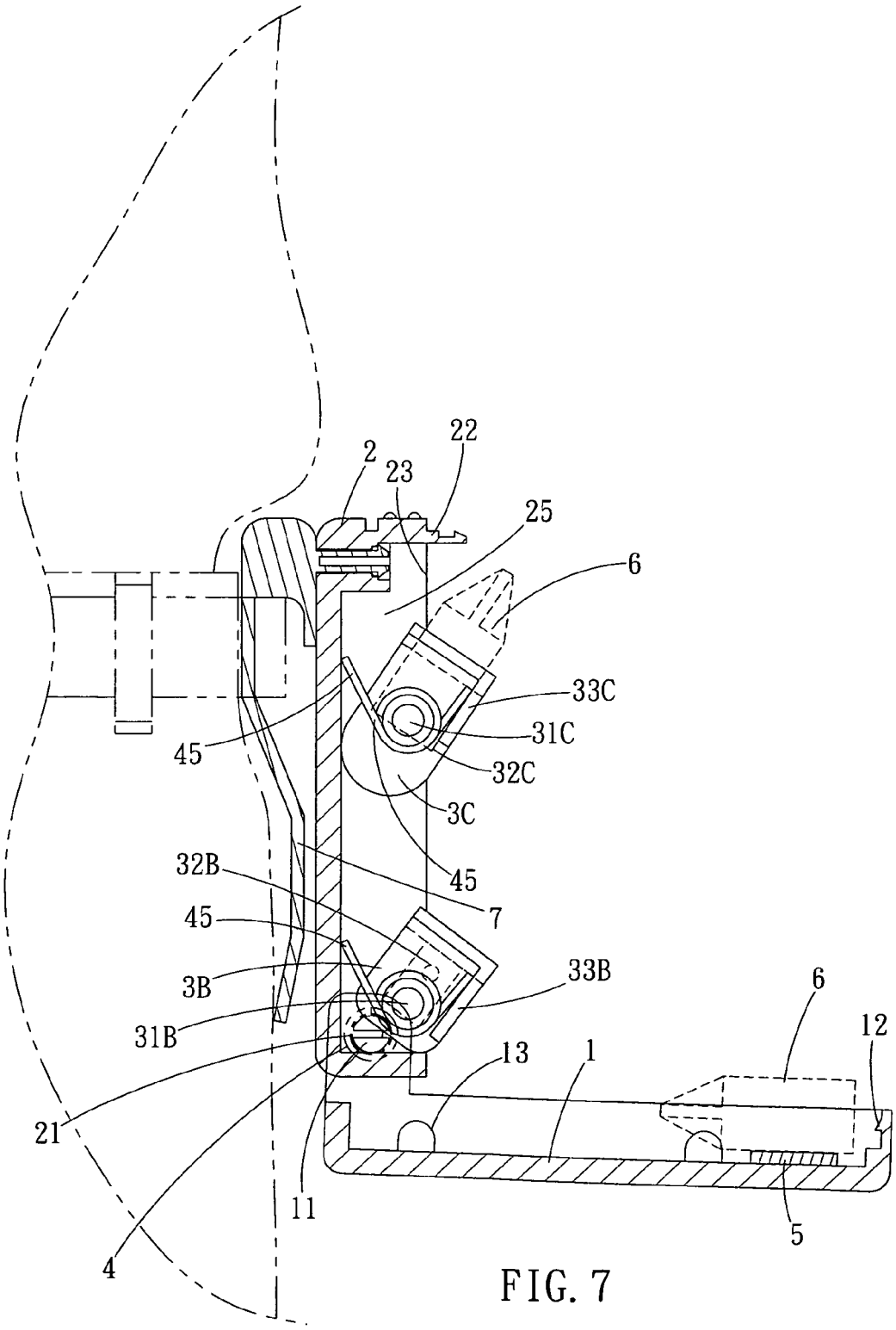
FIG. 7 is a cross sectional view to show the base is clipped to the user's belt and the cover is opened.

At least one separation plate 23 is connected to the base 2 to define two partitions 25 and the separation plate 23 has a plurality of first recesses 24. The base 2 includes second recesses 26 defined in an inside of sidewalls thereof. A plurality of storage racks 3A, 3B and 3C are pivotably connected to the base 2 and each of the storage racks 3A/3B/3C includes two protrusions 31A/31B/31C on two ends thereof, the two protrusions 31A/31B/31C are engaged with the first and second recesses 24, 26. Each of the storage racks 3A, 3B and 3C includes a plurality of engaging recesses 32 so as to receive bits 6 or small tools or parts therein. A stop plate 33B/33C is located above the protrusion 31B/31C of the storage racks 3B, 3C, and each protrusion 31B/31C has a torsion spring 45 mounted thereto and two legs of each torsion spring 45 are in contact with the stop plate 33 and the base 2. A clip 7 is connected to an underside of the base 2 so that the tool box can be clipped to the user's belt as shown in FIG. 7.

When the user unlocks the first locking member 12 from the second locking member 22, the torsion springs 4 pivot the cover 1 to its opened status wherein the cover 1 is stopped at a substantially horizontal position relative to the base 2. The storage racks 3B, 3C are pivoted an angle by the torsion spring 45 so that the user can easily access the bits 6. The spare bits 6 can be easily put in the horizontal cover 1 and positioned by the magnetic member 5.

When closing the cover 1, the pressing members 13 press the storage racks 3B, 3C toward the base 2 and the first and second locking members 12, 22 are then locked to each other to maintain the closes position of the cover 1.

While we have shown and described the embodiment in accordance with the present invention, it should be clear to those skilled in the art that further embodiments may be made without departing from the scope of the present invention.

What is claimed is:

1. A tool box comprising:

a cover having a side pivotably connected to a side of a base, a first locking member connected to an inside of a front wall of the cover and a plurality of pressing members connected to an inside of the cover;

the base having a second locking member connected to a front wall thereof and the first locking member on the cover disengagably snapped with the second locking member on the base, at least one torsion spring located between the cover and the base to maintain the cover at opened status when the first locking member is separated from the second locking member, a plurality of storage racks pivotably connected to the base and at least one separation plate connected to the base, the at least one separation plate having a plurality of first recesses, the base includes second recesses defined in an inside of sidewalls thereof, each storage rack including two protrusions on two ends thereof, the two protrusions engaged with the first and second recesses, a stop plate located above the protrusion of each storage rack and each protrusion having a torsion spring mounted thereto, two legs of each of the torsion springs being in contact with the stop plate corresponding thereto and the base, the pressing members pressing the storage racks toward the base when the cover is pivoted toward the base, and a magnetic member connected to an inside of the cover.

2. The tool box as claimed in claim 1, wherein the cover includes two lugs on the side that is pivotably connected to the side of the base and each lug includes a hole, the base includes two pivots on two ends of the side that is pivotably connected to the side having the two lugs of the cover, the pivots extend through the two holes in the lugs of the cover, the at least one torsion spring is mounted to one of the pivots and includes two legs which are in contact with the cover and the base.

3. The tool box as claimed in claim 1, wherein a clip is connected to an underside of the base.

4. The tool box as claimed in claim 1, wherein the cover is stopped at a substantially horizontal position relative to the base when the cover is at the opened status.

5. The tool box as claimed in claim 1, wherein each of the storage racks includes a plurality of engaging recesses which are adapted to receive bits.

* * * * *